US011308859B2

(12) United States Patent
Chen et al.

(10) Patent No.: US 11,308,859 B2
(45) Date of Patent: Apr. 19, 2022

(54) SHIFT REGISTER CIRCUIT AND METHOD OF DRIVING THE SAME, GATE DRIVER CIRCUIT, ARRAY SUBSTRATE AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Kai Chen, Beijing (CN); Mo Chen, Beijing (CN); Siying Lu, Beijing (CN); Fangqing Li, Beijing (CN); Wenbo Dong, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 370 days.

(21) Appl. No.: 16/473,968

(22) PCT Filed: Jan. 14, 2019

(86) PCT No.: PCT/CN2019/071649

§ 371 (c)(1),
(2) Date: Jun. 26, 2019

(87) PCT Pub. No.: WO2019/227945

PCT Pub. Date: May 12, 2019

(65) Prior Publication Data

US 2021/0335208 A1 Oct. 28, 2021

(30) Foreign Application Priority Data

Jun. 1, 2018 (CN) ..... 201810555823.9

(51) Int. Cl.
*G09G 3/32* (2016.01)

(52) U.S. Cl.
CPC ..... *G09G 3/32* (2013.01); *G09G 2300/0408* (2013.01); *G09G 2310/0286* (2013.01); *G09G 2310/061* (2013.01); *G09G 2320/041* (2013.01)

(58) Field of Classification Search
CPC ..... G09G 3/32; G09G 3/3677; G09G 3/3676; G09G 3/3696; G09G 3/20; G09G 3/2092;
(Continued)

(56) References Cited

U.S. PATENT DOCUMENTS 8,704,815 B2 * 4/2014 Li ..... G09G 3/3696 345/211
8,923,472 B2 * 12/2014 Sasaki ..... G09G 3/3677 377/64

(Continued)

FOREIGN PATENT DOCUMENTS

CN 101105923 A 1/2008
CN 101598859 A 12/2009

(Continued)

OTHER PUBLICATIONS

International Search Report and Written Opinion dated Mar. 27, 2019; PCT/CN2019/071649.

(Continued)

*Primary Examiner* — Nijay Shankar

(57) ABSTRACT

A shift register circuit and a method of driving the same, a gate driver circuit, an array substrate and a display device. The shift register circuit includes an input subcircuit and a signal output subcircuit. The input subcircuit includes: a control module, which is configured to output a signal of the first voltage terminal to a voltage dividing node under a control of an input signal; an input module configured to output a signal of the voltage dividing node to the signal output subcircuit under a control of the control module; and a voltage dividing module, a resistance value of the voltage (Continued)

dividing module having a negative relationship with a temperature, and the signal output subcircuit is connected with an output terminal of the input module and configured to output a gate scan signal from an output signal terminal under a control of the input module.

18 Claims, 9 Drawing Sheets

(58) Field of Classification Search
CPC ... G09G 2300/0408; G09G 2300/0426; G09G 2310/061; G09G 2310/0218; G09G 2310/0286; G09G 2320/041
See application file for complete search history.

(56) References Cited

U.S. PATENT DOCUMENTS

| | | | | |
|---|---|---|---|---|
| 9,947,281 | B2 | 4/2018 | Wang | |
| 10,043,477 | B2 | 8/2018 | Li | |
| 10,180,752 | B2 * | 1/2019 | Kim | G06F 3/04166 |
| 10,210,840 | B2 | 2/2019 | Wang | |
| 11,004,375 | B2 * | 5/2021 | Xu | G09G 3/20 |
| 2012/0105411 | A1 | 5/2012 | Li et al. | |

FOREIGN PATENT DOCUMENTS

| | | | |
|---|---|---|---|
| CN | 102694531 | A | 9/2012 |
| CN | 103098373 | A | 5/2013 |
| CN | 104700814 | A | 6/2015 |
| CN | 105355187 | A | 2/2016 |
| CN | 105549289 | A | 5/2016 |
| CN | 105632560 | A | 6/2016 |
| CN | 106098003 | A | 11/2016 |
| CN | 106356015 | A | 1/2017 |
| CN | 107452312 | A | 12/2017 |
| CN | 108766381 | A | 11/2018 |

OTHER PUBLICATIONS

The First Chinese Office Action dated Sep. 6, 2019; Appln. No. 201810555823.9.

* cited by examiner

SHIFT REGISTER CIRCUIT AND METHOD OF DRIVING THE SAME, GATE DRIVER CIRCUIT, ARRAY SUBSTRATE AND DISPLAY DEVICE

CROSS-REFERENCE TO RELATED APPLICATION

The present application claims priority to Chinese Patent Application No. 201810555823.9, filed on Jun. 1, 2018, the disclosure of which is incorporated herein by reference in its entirety as part of the present application.

TECHNICAL FIELD

The embodiments of the present disclosure relate to a shift register circuit and a method of driving the same, a gate driver circuit, an array substrate and a display device.

BACKGROUND

A TFT-LCD (Thin Film Transistor Liquid Crystal Display) includes a pixel matrix, outputs a gate scan signal through a gate driver circuit during the display process, progressively scans and accesses each pixel. The gate driver circuit is configured for generating the gate scan signal of the pixel. GOA (Gate Driver on Array) is a technology of integrating the gate driver circuit onto a TFT (Thin Film Transistor) substrate; each GOA unit functions as a shift register to transfer the gate scan signal to the next GOA unit in sequence, turns on TFT switches of the pixels row by row, thereby inputting the gate scan signal of the pixel.

SUMMARY

The embodiments of the present disclosure provide a shift register circuit, which includes an input subcircuit and a signal output subcircuit, wherein the input subcircuit comprises:

a control module, the control module being connected with an input signal terminal and a first voltage terminal, and the control module being configured to output a signal of the first voltage terminal to a voltage dividing node under a control of an input signal provided by the input signal terminal;

an input module, an input terminal of the input module being connected with the voltage dividing node, an output terminal of the input module being connected with the signal output subcircuit, the input module being configured to output a signal of the voltage dividing node to the signal output subcircuit under a control of the control module; and a voltage dividing module, a first terminal of the voltage dividing module being connected with the control module, a second terminal of the voltage dividing module being connected with a second voltage terminal, a resistance value of the voltage dividing module having a negative relationship with a temperature, and the signal output subcircuit is connected with an output terminal of the input module, and the signal output subcircuit is configured to output a gate scan signal from an output signal terminal under a control of the input module.

The embodiments of the present disclosure further provide a gate driver circuit, which includes a plurality of cascaded shift register circuits, each of the plurality of cascaded shift register circuits being the shift register circuit as mentioned above.

The embodiments of the present disclosure further provide an array substrate, which includes the gate driver circuit as mentioned above.

The embodiments of the present disclosure further provide a display device, comprising the array substrate as mentioned above.

The embodiments of the present disclosure further provide a method of driving the shift register circuit as mentioned above, which includes:

inputting a signal having an effective potential to the input signal terminal, inputting a signal having an invalid potential to the first clock signal terminal so that the control module outputs an effective potential signal from the first voltage terminal to the voltage dividing node, and the input module outputs the signal of the voltage dividing node to the first node under the control of the control module, so as to charge the charging-discharging module;

inputting a signal having the effective potential to the first clock signal terminal, inputting a signal having an invalid potential to the input signal terminal to charge the charging-discharging module so that the charging-discharging module outputs a signal which is from the first clock signal terminal and has the effective potential to the output signal terminal under a control of the first node; and inputting a signal having the effective potential to the reset signal terminal and the second clock signal terminal so that the second node level changing module changes the potential of the second node to the effective potential, and the reset module outputs the invalid potential signal from the second voltage terminal to the output signal terminal under a control of the second node at the effective potential and the reset signal terminal at the effective potential.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
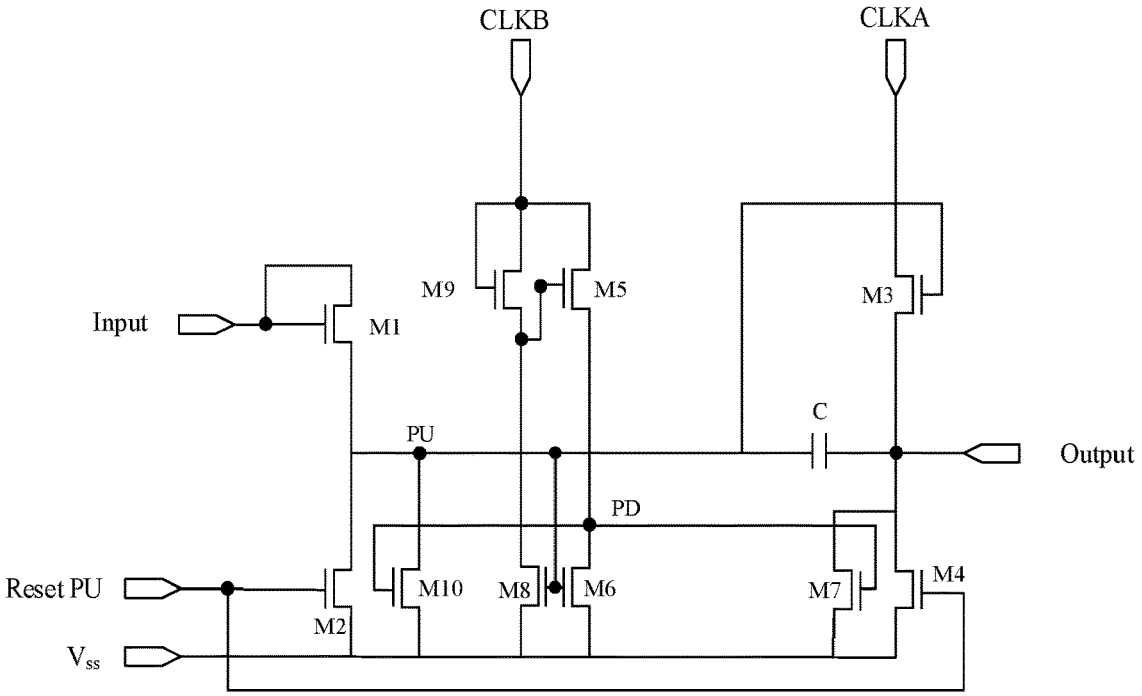
FIG. 1 is a structural diagram of a shift register circuit.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The transistors used in all embodiments of the present disclosure may be thin film transistors or field effect transistors or other devices with the same characteristics, and the transistors used in the embodiments of the present disclosure are mainly switching transistors according to their functions in circuits. Because the source electrode and the drain electrode of the switching transistor used herein are symmetrical, the source electrode and the drain electrode are interchangeable. In the embodiments of the present disclosure, the source drain is referred to as a first electrode and the drain electrode is referred to as a second electrode; however, it should be understood that in other embodiments, the source electrode may also be a second electrode and the drain electrode may also be a first electrode, and the embodiments of the present disclosure are not limited thereto.

The switching transistors used in the embodiments of the present disclosure may include P-type switching transistors and N-type switching transistors, wherein the P-type switching transistors are turned on when the gate electrodes are at a low level and turned off when the gate electrodes are at a high level, while the N-type switching transistors are turned on when the gate electrodes are at a high level and turned off when the gate electrodes are at a low level. In addition, a plurality of signals in various embodiments of the present disclosure each correspond to a high potential and a low potential, and the effective potential of the signals is a potential that turns on the switching transistor, for example, for a P-type switching transistor, the low potential is an effective potential, and for an N-type switching transistor, the high potential is an effective potential.

In the embodiments of the present disclosure, for example, when each circuit is implemented by N-type transistors, the term "pull-up" means charging a node or an electrode of a transistor so as to increase the absolute value of the level of the node or the electrode, thereby realizing the operation (e.g., turning-on) of the corresponding transistor; the term "pull-down" refers to discharging a node or an electrode of a transistor so as to decrease the absolute value of the level of the node or the electrode, thereby realizing the operation (e.g., turning-off) of the corresponding transistor.

For another example, when each circuit is implemented by P-type transistors, the term "pull-up" means discharging a node or an electrode of a transistor so as to decrease the absolute value of the level of the node or the electrode, thereby realizing the operation (e.g., turning-on) of the corresponding transistor; the term "pull-down" means charging a node or an electrode of a transistor so as to increase the absolute value of the level of the node or the electrode, thereby realizing the operation (e.g., turning-off) of the corresponding transistor.

In addition, the specific meanings of the terms "pull-up" and "pull-down" will also be adjusted according to the specific type of the transistor used, as long as the control of the transistor may be realized and the corresponding switching function may be achieved.

Hereinafter, the embodiments of the present disclosure will be described by taking the case where the circuits are implemented by N-type transistors as an example. However, it should be understood that the present disclosure is not limited thereto.

In the shift register circuit of the related art, a control terminal of a thin film transistor device configured for controlling the input of signals operates at different temperatures, which causes the threshold voltage of the thin film transistor to shift, deteriorates the stability of the shift register circuit during a long-term display process of a panel, and disturbs the output of a normal scan signal. FIG. 1 shows a shift register circuit. The shift register circuit may be applied in different environment, the practical operating temperature of the thin film transistor is not fixed, and thus a threshold voltage of the thin film transistor tends to shift as the temperature changes. At low temperatures, the threshold voltage of a first thin film transistor M1 becomes greater, and the turning on of the first thin film transistor M1 occurs later, which causes the insufficient charging of capacitors. The insufficient charging of capacitors may result in a relatively low potential of a first node PU, relatively long rising time and falling time of the voltage of the control terminal, an insufficient charging ratio of an in-plane thin film transistor, and thus a screen brightness fails to be up to standard. At high temperatures, the threshold voltage of the first thin film transistor M1 becomes less, the turning on of the first thin film transistor M1 occurs earlier, the first node PU is charged earlier, and the shift register circuit is turned on earlier, which causes a row to output at the same time as a previous row. Therefore, signal interference between rows and abnormal screens occur.

Based on the above-mentioned current situation, the technical solutions of the present disclosure propose: by providing at different temperatures different voltages to the control terminal of the thin film transistor which is configured for controlling the input of signals, a temperature compensation of the voltage at the control terminal is implemented, thereby alleviating the phenomenon that the shift register circuit is insufficiently charged at low temperatures due to the threshold voltage shift of the thin film transistor configured for controlling signal input, and the output signals are abnormal at high temperatures.

At least one embodiment of the present disclosure provides a shift register circuit, which includes an input subcircuit and a signal output subcircuit. The input subcircuit includes a control module, an input module and a voltage dividing module. The control module is connected with an input signal terminal and a first voltage terminal, and the control module is configured to output the signal of the first voltage terminal to a voltage dividing node under the control of the input signal. An input terminal of the input module is connected with the voltage dividing node, an output terminal of the input module is connected with the signal output subcircuit, and the input module is configured to output a signal of the voltage dividing node to the signal output subcircuit under the control of the control module. A first terminal of the voltage dividing module is connected with the control module, a second terminal of the voltage dividing module is connected with a second voltage terminal, and a resistance value of the voltage dividing module has a negative relationship with the temperature. The signal output subcircuit is connected with an output terminal of the input module, and the signal output subcircuit is configured to output the gate scan signal to the output signal terminal under the control of the input module.

Figure 2:
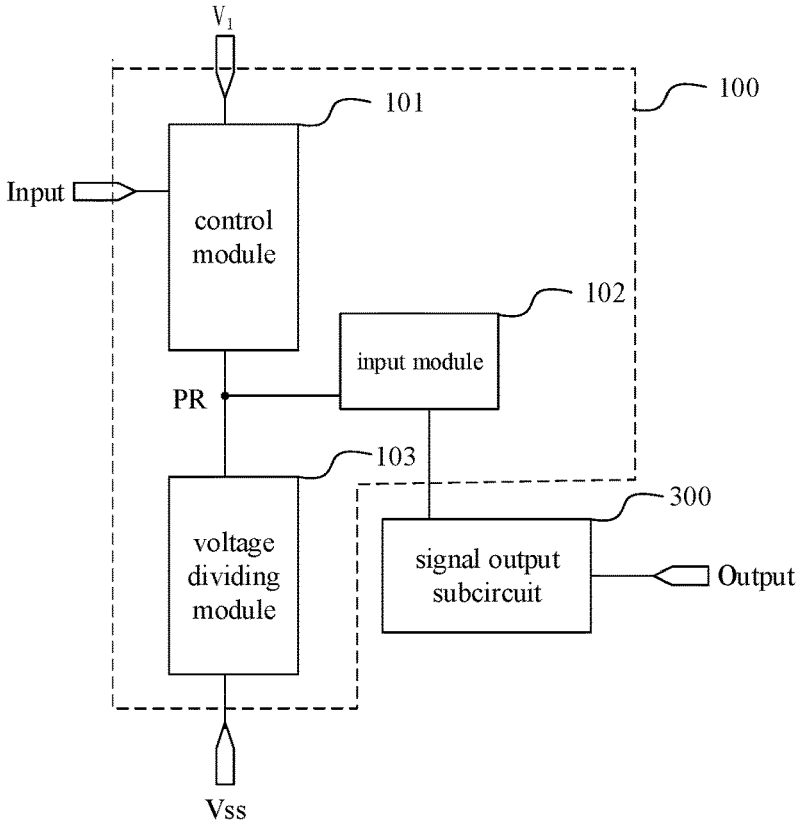
FIG. 2 is a structural diagram of a shift register circuit according to at least one embodiment of the present disclosure.

As shown in FIG. 2, the embodiments of the present disclosure provide a shift register circuit, including an input subcircuit 100 and a signal output subcircuit 300, wherein the input subcircuit 100 includes a control module 101, an input module 102 and a voltage dividing module 103; the control module 101 is connected with an input signal terminal Input and a high-level signal terminal $V_1$, the control module 101 is configured to output the signal of the high-level signal terminal $V_1$ to a voltage dividing node PR under the control of the input signal; an input terminal of the input module 102 is connected with the voltage dividing node PR, an output terminal of the input module 102 is connected with the signal output subcircuit 300, the input module 102 is configured to output a signal of the voltage dividing node PR to the signal output subcircuit 300 under the control of the control module 101; the voltage dividing module 103 is connected with the control module 101 and a low-voltage signal terminal $V_{ss}$, a resistance value of the voltage dividing module 103 has a negative relationship with the temperature; the signal output subcircuit 300 is connected with an output terminal of the input module 102, and the signal output subcircuit 300 is configured to output the gate scan signal to the output signal terminal under the control of the input module 102. The high-level signal terminal $V_1$ is an example of the above-mentioned first voltage terminal, and the low-level signal terminal $V_{ss}$ is an example of the above-mentioned second voltage terminal. In the embodiments of the present disclosure, the first voltage terminal is configured for inputting an effective potential signal which turns on a switch transistor, and the second voltage terminal is configured for inputting an invalid potential signal which turns off the switch transistor.

In some embodiments, the input module 102 includes a first thin film transistor M1, a control terminal and a first terminal of which are connected with the voltage dividing node PR, and a second terminal of which is connected with the signal output subcircuit 300.

The control module 101 is switched on under the control of the input signal to output a high-level signal, thereby turning on the first thin film transistor M1, and the signal output subcircuit 300 outputs the gate driver signal under the control of the first thin film transistor M1. The voltage dividing module 103 is configured for dividing the voltage of the first thin film transistor M1. In a low temperature situation, the threshold voltage becomes greater due to the low temperature at the control terminal of the first thin film transistor M1; by providing the voltage dividing module 103 in the shift register circuit, the voltage dividing module 103 has a relatively large resistance value at the low temperature, and thus the voltage across the voltage dividing module 103 is relatively high, the potential of the voltage dividing node PR rises, and a high voltage is given to the control terminal of the first thin film transistor M1, so as to compensate the shifting of the threshold voltage. In a high temperature situation, the threshold voltage becomes less due to the high temperature at the control terminal of the first thin film M1, the voltage across the voltage dividing module 103 is reduced at the high temperature, and the potential of the voltage dividing node PR decreases. Although the potential at the control terminal of the first thin film transistor M1 is relatively low, a relatively high level is input to the high-level signal terminal $V_1$. Even if the potential at the control terminal of the first thin film transistor M1 is relatively low at this point, the capacitor charging requirements may be met, thereby compensating the shifting of the threshold voltage.

In some embodiments, the control module includes an input thin film transistor, a control terminal of the input thin film transistor is connected with an input signal terminal, a first terminal of the input thin film transistor is connected with a first voltage terminal, and a second terminal of the input thin film transistor is connected with the voltage dividing node.

For example, in some embodiments, the control module 101 includes an eleventh thin film transistor M11, a control terminal of the eleventh thin film transistor M11 is connected with the input signal terminal Input, a first terminal of the eleventh thin film transistor M11 is connected with the high-level signal terminal $V_1$, and a second terminal of the eleventh thin film transistor M11 is connected with the voltage dividing node PR. The eleventh thin film transistor M11 is an example of the above-mentioned input thin film transistor.

In some embodiments, the high-level signal terminal $V_1$ is a power supply voltage signal terminal $V_{gh}$, configured for inputting a high-level signal to the shift register circuit. The signal output from the high-level signal terminal $V_1$ is 27V~36V. The amplitude of the signal output from the high-level signal terminal $V_1$ is determined according to the TFT characteristics of different products, for example, 27V, 30V, 36V, or the like based on actual use conditions.

In some embodiments, the voltage dividing module 103 includes a thermistor R, a terminal of the thermistor R is connected with the voltage dividing node PR, and the other terminal of the thermistor R is connected with the low-level signal terminal $V_{ss}$. The selection of the thermistor is mainly determined based on an off-state resistance value of the eleventh thin film transistor M11. Since the shift register is in an off state in more cases, the eleventh thin film transistor M11 in an off state and the thermistor R divide the voltage. In order to reduce the influence of a bias voltage on the control terminal of the first thin film transistor M1, the thermistor R with a suitable resistance value is usually selected to make the potential at the voltage dividing point close to 0V. The thermistor R may be a negative temperature coefficient thermistor, which is a sensor resistor with a resistance value which decreases with an increase in temperature. A zero power resistance of the selected negative temperature coefficient thermistor is in a range of 210Ω-230Ω at the operating temperature in a range of −25° C.~105° C. For example, the TPM1S221N090R thermistor of the TPM-S series may be used.

In some embodiments, the signal output subcircuit may include a charging-discharging module, a second node holding module, a second node level changing module, a first node nose reduction module and a reset module.

A first input terminal of the charging-discharging module is connected with the output terminal of the input module and the output terminal of the first node noise reduction module at the first node, the second input terminal of the charging-discharging module is connected with the first clock signal terminal, and the output terminal of the charging-discharging module is connected with the output signal terminal. The charging-discharging module is configured for performing a first charging operation under the combined action of the output signal of the first thin film transistor and the first clock signal in the first phase, and performing a second charging operation and outputting the gate scan signal under the action of the potential of the first node and the first clock signal in the second phase.

A first input terminal of the second node holding module is connected with the second voltage terminal, a second input terminal of the second node holding module is connected with the first node, a first output terminal of the second node holding module is connected with the second input terminal of the second node level changing module, the second output terminal of the second node holding module is connected with the output terminal of the second node level changing module, the third input terminal of the first node noise reduction module and the second input terminal of the reset module at the second node, and the second node holding module is configured for keeping the potential of the second node invalid under the combined action of the potential of the first node and the invalid potential signal in the first and second phases.

The first input terminal of the second node level changing module is connected with the second clock signal terminal, the second input terminal of the second node level changing module is connected with the first output terminal of the second node holding module, the output terminal of the second node level changing module is connected with the second node, and the second node level changing module is configured for changing the potential of the second node under the combined action of the second clock signal and the output signal of the second node holding module in the third phase.

The first input terminal of the first node noise reduction module is connected with the reset signal terminal, the second input terminal of the first node noise reduction module is connected with the second voltage terminal, the third input terminal of the first node noise reduction module is connected with the second node, the output terminal of the first node noise reduction module is connected with the first node, and the first node noise reduction module is configured for changing the potential of the first node under the combined action of the reset signal, invalid potential signal and the potential of the second node in the third phase.

The first input terminal of the reset module is connected with the reset signal terminal, the second input terminal of the reset module is connected with the second node, the third input terminal of the reset module is connected with the second voltage terminal, the output terminal of the reset module is connected with the output signal terminal, and the reset module is configured for resetting the potential of the output signal terminal under the combined action of the reset signal, the potential of the second node and the invalid potential signal in the third phase.

The first clock signal has an inverted phase with respect to the second clock signal.

Figure 3:
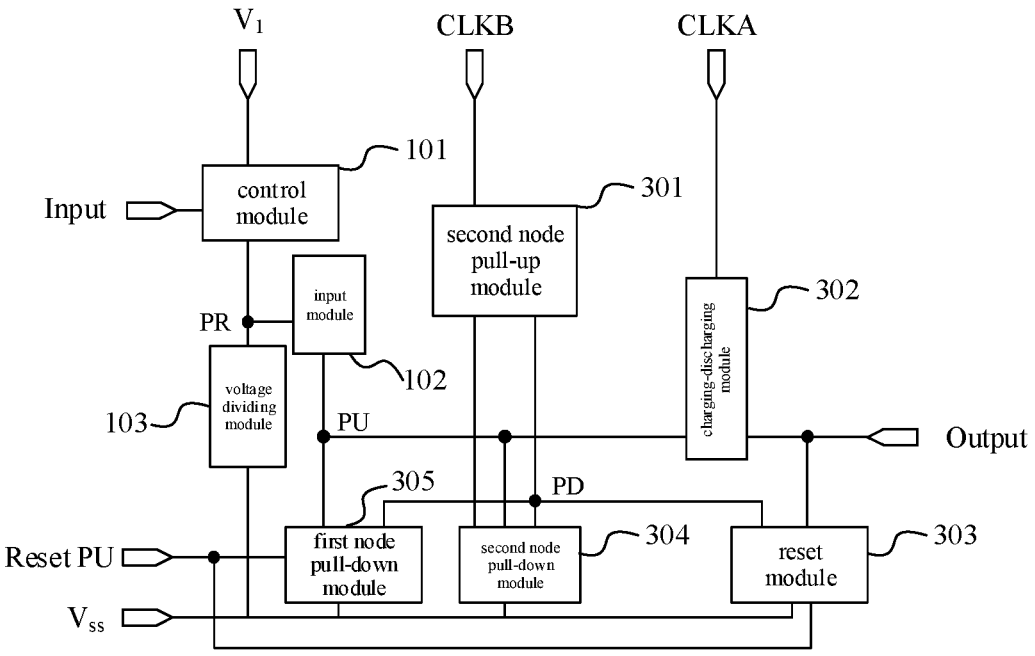
FIG. 3 is a structural diagram of a shift register circuit according to at least one embodiment of the present disclosure.

In some embodiments, one driving period of the shift register circuit includes first, second and third phases in sequence. As shown in FIG. 3, the signal output subcircuit 300 includes a charging-discharging module 302, a second node pull-down module 304, a second node pull-up module 301, a first node pull-down module 305 and a reset module 303; wherein the first input terminal of the charging-discharging module 302 is connected with the output terminal of the input module 102 and the output terminal of the first node pull-down module 305, the charging-discharging module 302, the input module 102 and the first node pull-down module 305 are commonly connected at the first node PU, the second input terminal of the charging-discharging module is connected with the first clock signal terminal CLKA, the output terminal of the charging-discharging module is connected with the output signal terminal Output, the charging-discharging module 302 is configured for performing a first charging operation under the combined action of the output signal of the input module 102 and the first clock signal CLKA in the first phase, and performing a second charging operation and outputting the gate scan signal under the action of potential of the first node PU and the first clock signal CLKA in the second phase; the first input terminal of the second node pull-down module 304 is connected with the low-level signal terminal, the second input terminal of the second node pull-down module 304 is connected with the first node PU, the first output terminal of the second node pull-down module 304 is connected with the second input terminal of the second node pull-up module 301, the second output terminal of the second node pull-down module 304 is connected with the output terminal of the second node pull-up module 301, the third input terminal of the first node pull-down module 305 and the second input terminal of the reset module 303, the second node pull-down module 304, the second node pull-up module 301, the first node pull-down module 305 and the reset module 303 are commonly connected at the second node PD, and the second node pull-down module 304 is configured for keeping the potential of the second node PD low under the combined action of the potential of the first node PU and the low-level signal in the first and second phases; the first input terminal of the second node pull-up module 301 is connected with the second clock signal terminal CLKB, the second input terminal of the second node pull-up module is connected with the first output terminal of the second node pull-down module 304, the output terminal of the second node pull-up module is connected with the second node PD, the second node pull-up module 301 is configured for pulling up the potential of the second node PD under the combined action of the second clock signal and the output signal of the second node pull-down module in the third phase; the first input terminal of the first node pull-down module 305 is connected with the reset signal terminal Reset PU, the second input terminal of the first node pull-down module is connected with the low-level signal terminal, the third input terminal of the first node pull-down module is connected with the second node PD, the output terminal of the first node pull-down module is connected with the first node PU, the first node pull-down module 305 is configured for pulling down the first node PU to reduce noise at the first node PU under the combined action of the reset signal, the low-level signal and the potential of the second node PD in the third phase; the first input terminal of the reset module 303 is connected with the reset signal terminal Reset PU, the second input terminal of the reset module is connected with the second node PD, the third input terminal of the reset module is connected with the low-level signal terminal, the output terminal of the reset module is connected with the output signal terminal Output, and the reset module 303 is configured for resetting the potential of the output signal terminal Output under the combined action of the reset signal, the potential of the second node PD and the low-level signal in the third phase. The second node pull-down module 304 is an example of the above-mentioned second node holding module, the second node pull-up module 301 is an example of the above-mentioned second node level changing module, and the first node pull-down module 305 is an example of the above-mentioned first node noise reduction module. In addition, the low-level signal is an example of the above-mentioned invalid potential signal.

The first clock signal has an inverted phase with respect to the second clock signal. The high-level signal terminal $V_1$ is connected with the power supply voltage signal terminal $V_{gh}$ which may provide a high-level signal, and may be also connected with the clock signal terminal CI. For example, the high-level signal terminals $V_1$ of the shift register circuits in odd-numbered rows are connected with the first clock signal terminal CLKA, the high-level signal terminals of the shift register circuits in even-numbered rows are connected with the second clock signal terminal CLKB; or, the high-level signal terminals of the shift register circuits in even-numbered rows are connected with the first clock signal terminal CLKA, and the high-level signal terminals of the shift register circuits in odd-numbered rows are connected with the second clock signal terminal CLKB. The high-level signal is an example of the above-mentioned effective potential signal.

The driving period of the above-mentioned shift register circuit includes three phases in sequence, in which the high-level signal terminal $V_1$ keeps inputting high level, and the low-level signal terminal $V_{ss}$ keeps inputting low level. The three phases are the following phases in sequence.

In a first phase $t_1$, the input signal terminal Input and the second clock signal terminal CLKB output a high level, the reset signal terminal Reset PU and the first clock signal terminal CLKA output a low level, the control module 101 is switched on, the voltage dividing module 103 divides the voltage of the input module 102, the first thin film transistor M1 in the input module 102 is switched on to pull up the voltage of the first node PU, and the charging-discharging module 302 is switched on and performs the first charging operation. The first node pull-down module 305 and the reset module 303 are switched off, the second node pull-down module 304 and the second node pull-up module 301 are switched on, and the low-level signals output from the reset signal terminal Reset PU and the first clock signal terminal CLKA pull down the potential of the second node PD. In the first phase $t_1$, after the first thin film transistor M1 is turned on, the temperature rises gradually, the threshold voltage at the control terminal of the first thin film transistor M1 decreases gradually due to high temperatures, the voltage across the voltage dividing module 103 at the high temperatures decreases gradually, and the potential of the voltage dividing node PR decreases gradually so that the voltage at the control terminal of the first thin film transistor M1 is relatively low. However, since a relatively high level is input to the high-level signal terminal $V_1$, even if the potential at the control terminal of the first thin film transistor M1 is relatively low at this point, the capacitor charging requirements may also be met, thereby compensating the shifting of the threshold voltage.

In a second phase $t_2$, the first clock signal terminal CLKA outputs a high level, the input signal terminal Input, the second clock signal terminal CLKB and the reset signal terminal Reset PU output the low level, the control module 101 is switched off, the input module 102 is switched off, the charging-discharging module 302 performs the second charging operation, the voltage of the first node PU continues to rise, and the output signal terminal Output outputs the high-level gate driving signal. The first node pull-down module 305 and the reset module 303 are switched off, the second node pull-down module 304 and the second node pull-up module 301 are switched on, and the low-level signals output from the reset signal terminal Reset PU and the second clock signal terminal CLKB pull down the potential of the second node PD. In the second phase $t_2$, the temperature gradually reduces after the input module 102 is switched off, the threshold voltage at the control terminal of the first thin film transistor M1 in the input module 102 gradually becomes higher due to low temperatures, the resistance value of the voltage dividing module 103 becomes greater due to the low temperatures, thus the voltage across the voltage dividing module 103 becomes higher, the potential of the voltage dividing node PR rises, and a high voltage is given to the control terminal of the first thin film transistor M1 gradually, so as to compensate the shifting of the threshold voltage.

In a third phase $t_3$, the reset signal terminal Reset PU and the second clock signal terminal CLKB output a high level, the input signal terminal Input and the first clock signal terminal CLKA output a low level, the control module 101 is switched off, the input module 102 is switched off, and the voltage dividing module 103 continuously plays a role of dividing the voltage of the input module 102 at the low temperature. The second node pull-up module 301 is switched on, the potential of the second node PD is pulled up; the second node pull-down module 304 is switched off, the first node pull-down module 305 outputs the low-level signal to the first node PU, pulls down the potential of the first node PU, and reduces noise of the first node PU; the reset module 303 is switched on, so as to output the low-level signal to the output signal terminal Output and reset the potential of the output signal terminal Output.

From the first phase $t_1$ to the third phase $t_3$, during the driving time period of one gate line in one frame, the output signal terminal Output outputs a high-level pulse signal which lasts for the time of $t_2$, and this high-level pulse signal is output to the gate line connected with the shift register circuit at this stage, thereby driving this gate line. The first phase $t_1$ to the third phase t3 are repeated to drive this gate line in the next frame.

From the above-mentioned shift register circuit and the processes during the driving period of the shift register circuit, it is known that by using the high-level signal input from the high-level signal terminal $V_1$, the first thin film transistor M1 in the input module 102 operates at both high and low temperatures, and the voltage dividing module 103 divides the voltage of the first thin film transistor M1. By giving different voltages to the control terminal of the first thin film transistor M1 at different temperatures, the temperature compensation is performed on the voltage at the control terminal of the first thin film transistor M1, thereby alleviating the phenomenon that the shift register circuit is insufficiently charged at low temperatures due to the threshold voltage shift of the thin film transistor configured for controlling signal input, and the output signals are abnormal at high temperatures, and improving the stability of the shift register circuit.

Figure 4:
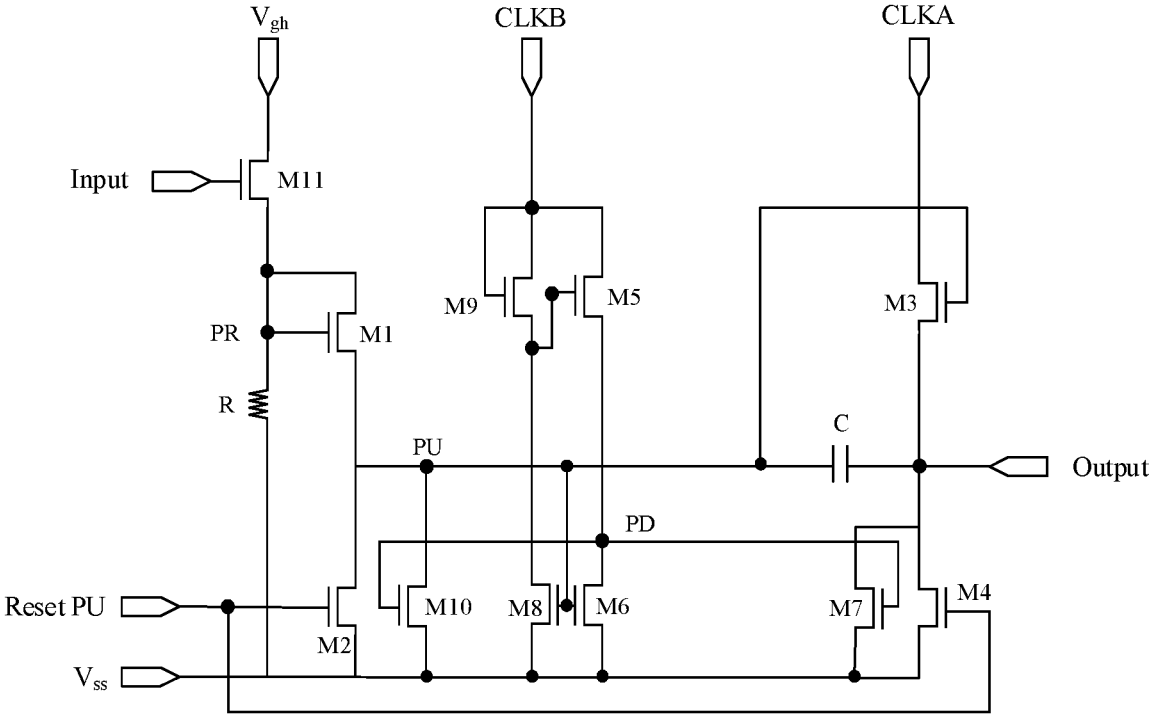
FIG. 4 is a structural diagram of a shift register circuit according to at least one embodiment of the present disclosure.
Figure 7:
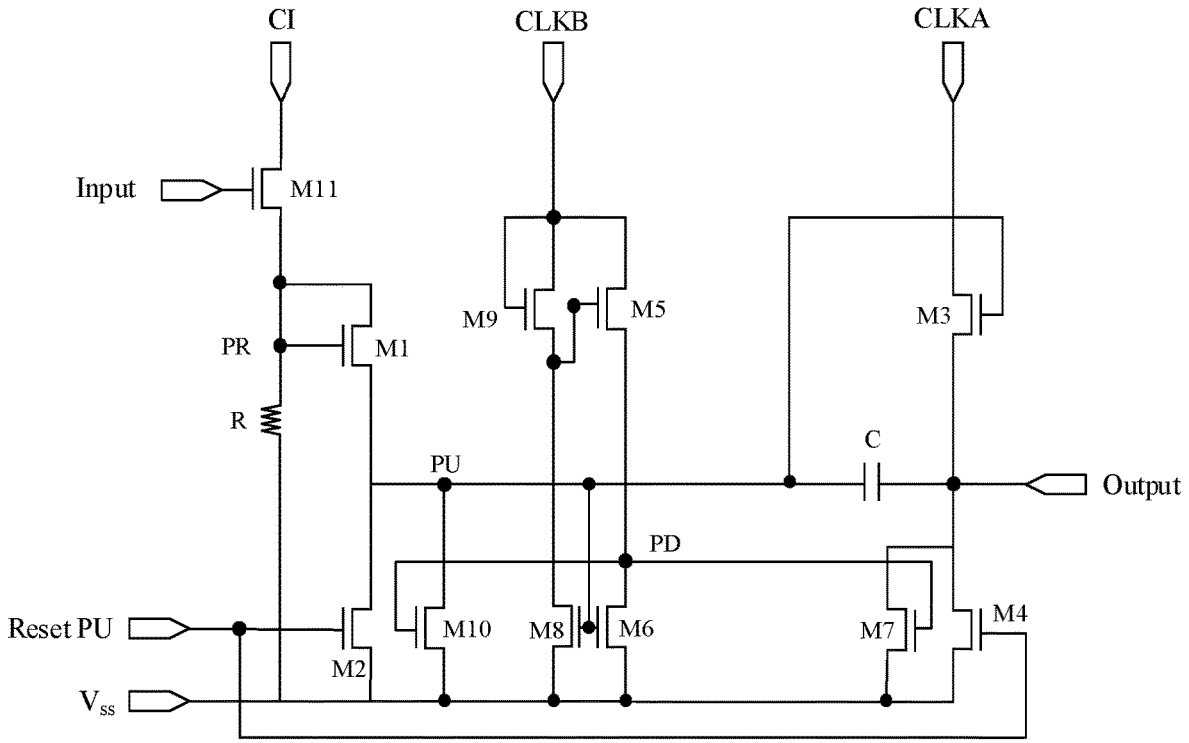
FIG. 7 is a structural diagram of a shift register circuit according to at least one embodiment of the present disclosure.

The specific structure of each functional unit of the shift register circuit according to the present embodiment will be exemplified below. As shown in FIG. 4 or 7, the charging-discharging module 302 includes a third thin film transistor M3 and a storage capacitor C. The control terminal of the third thin film transistor M3 is connected with the first node PU, the first terminal of the third thin film transistor M3 is connected with the first clock signal terminal CLKA, the second terminal of the third thin film transistor M3 is connected with the output signal terminal Output; the first terminal of the storage capacitor C is connected with the first node PU, and the second terminal of the storage capacitor C is connected with the output signal terminal Output.

The second node pull-down module 304 includes a sixth thin film transistor M6 and an eighth thin film transistor M8. The control terminal of the sixth thin film transistor M6 is connected with the first node PU, the first terminal of the sixth thin film transistor M6 is connected with the low-level signal terminal $V_{ss}$, the second terminal of the sixth thin film transistor M6 is connected with the second node PD; the control terminal of the eighth thin film transistor M8 is connected with the first node PU, the first terminal of the eighth thin film transistor M8 is connected with the low-level signal terminal $V_{ss}$, and the second terminal of the eighth thin film transistor M8 is connected with the second node pull-up module 301.

The second node pull-up module 301 includes a ninth thin film transistor M9 and a fifth thin film transistor M5. The control terminal and the first terminal of the ninth thin film transistor M9 are connected with the second clock signal terminal CLKB, the second terminal of the ninth thin film transistor M9 is connected with the control terminal of the fifth thin film transistor M5; the control terminal of the fifth thin film transistor M5 is connected with the second terminal of the ninth thin film transistor M9, the first terminal of the fifth thin film transistor M5 is connected with the low-level signal terminal $V_{ss}$, and the second terminal of the fifth thin film transistor M5 is connected with the first node PU.

The first node pull-down module 305 includes a second thin film transistor M2 and a tenth thin film transistor M10. The control terminal of the second thin film transistor M2 is connected with the reset signal terminal Reset PU, the first terminal of the second thin film transistor M2 is connected with the low-level signal terminal $V_{ss}$, the second terminal of the second thin film transistor M2 is connected with the first node PU; the control terminal of the tenth thin film transistor M10 is connected with the second node PD, the first terminal of the tenth thin film transistor M10 is connected with the low-level signal terminal $V_{ss}$, and the second terminal of the tenth thin film transistor M10 is connected with the first node PU.

The reset module 303 includes a fourth thin film transistor M4 and a seventh thin film transistor M7. The control terminal of the fourth thin film transistor M4 is connected with the reset signal terminal Reset PU, the first terminal of the fourth thin film transistor M4 is connected with the low-level signal terminal $V_{ss}$, the second terminal of the fourth thin film transistor M4 is connected with the output signal terminal Output; the control terminal of the seventh thin film transistor M7 is connected with the second node PD, the first terminal of the seventh thin film transistor M7 is connected with the low-level signal terminal $V_{ss}$, and the second terminal of the seventh thin film transistor M7 is connected with the output signal terminal Output.

It should be noted that the above-mentioned first to eleventh thin film transistors are of at least one type selected from a group of the P-type and the N-type. The first and second terminals of each of the above-mentioned thin film transistors may be interchangeable. In the present embodiment, the process of driving the shift register circuit with the above-mentioned specific structure is explained by taking the control terminal as a gate, the first terminal as a source, and the second terminal as a drain.

Figure 5:
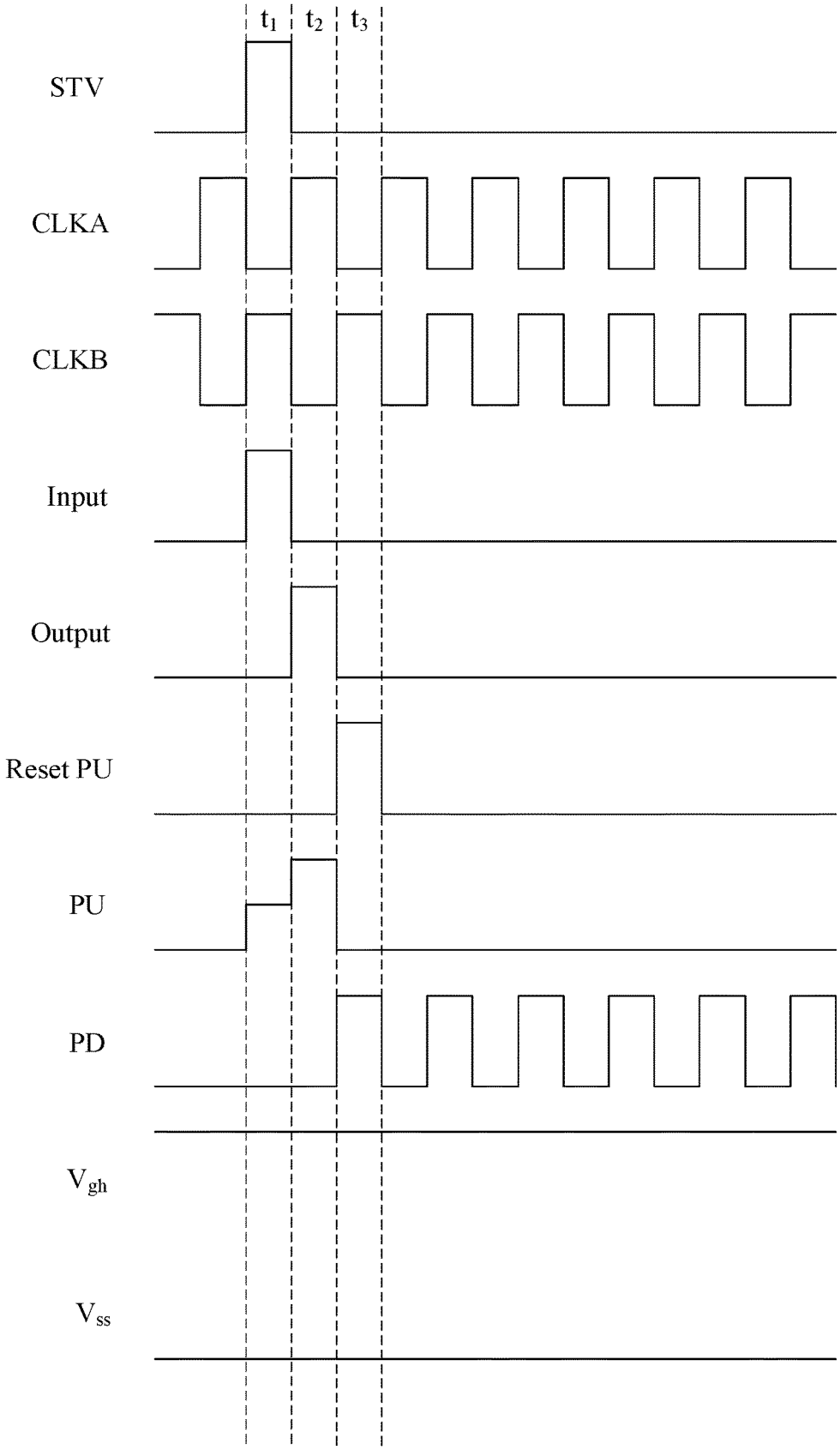
FIG. 5 is a driving timing diagram of a shift register circuit according to at least one embodiment of the present disclosure.

As shown in FIG. 5, the driving period of the shift register circuit according to the present embodiment includes three phases in sequence, and during the three phases, the high-level signal terminal $V_1$ is connected with the power supply voltage signal terminal $V_{gh}$, (as shown in FIG. 4) and keeps inputting a high level, and the low-level signal terminal $V_{ss}$ keeps inputting a low level.

In the first phase $t_1$, the input signal terminal Input and the second clock signal terminal CLKB output a high level, and the reset signal terminal Reset PU and the first clock signal terminal CLKA output a low level. The eleventh thin film transistor M11 is turned on to output a high level, the thermistor R in the voltage dividing module 103 divides the voltage of the first thin film transistor M1. The first thin film transistor M1 is turned on to pull up the voltage of the first node PU, and a first charging operation is performed on the storage capacitor C. The second clock signal terminal CLKB outputs a high level, and the ninth thin film transistor M9 and the fifth thin film transistor M5 are turned on. The first node PU is pulled up, the sixth and eighth thin film transistors M6 and M8 are turned on, and the voltage of the second node PD is pulled down using the low level given to the second node PD by the low-level signal terminal $V_{ss}$. The second, tenth, fourth and seventh thin film transistors M2, M10, M4 and M7 are turned off, and the first node pull-down module 305 and the reset module 303 do not output signals. The third thin film transistor M3 is turned on, and the output signal terminal Output outputs a low level.

In the second phase $t_2$, the first clock signal terminal CLKA outputs a high level, the input signal terminal Input, the second clock signal terminal CLKB and the reset signal terminal Reset PU output a low level, the eleventh thin film transistor M11 is turned off, and the first thin film transistor M1 is turned off. Due to the bootstrapping effect of the storage capacitor C, the level of the first node PU continues to rise, the sixth and eighth thin film transistors M6 and M8 are turned on, the second node pull-down module 304 outputs a low level, and the voltage of the second node PD continues to keep the low level. The third thin film transistor M3 is turned on, and the output signal terminal Output outputs a high-level signal. The second and tenth thin film transistors M2 and M10 are turned off, and the first node pull-down module 305 does not output signals. The fourth and seventh thin film transistors M4 and M7 are turned off, and the reset module 303 does not output signals. The fifth and ninth thin film transistor M5 and M9 are turned off, and the second node pull-up module 301 does not output signals.

In the third phase $t_3$, the reset signal terminal Reset PU and the second clock signal terminal CLKB output a high level, the input signal terminal Input and the first clock signal terminal CLKA output a low level, the eleventh thin film transistor M11 is turned off, and the first thin film transistor M1 is turned off. The fifth and ninth thin film transistors M5 and M9 are turned off, and the potential of the second node PD is pulled up. The second and tenth thin film transistors M2 and M10 are turned on, and the first node PU is pulled down to the low level, thereby turning off the third thin film transistor M3. The sixth and eighth thin film transistor M6 and M8 are turned off, and the second node pull-down module 304 does not output signals. The fourth and seventh thin film transistors M4 and M7 are turned on, and the potential of the output signal terminal Output is reset to the low level.

Figure 6:
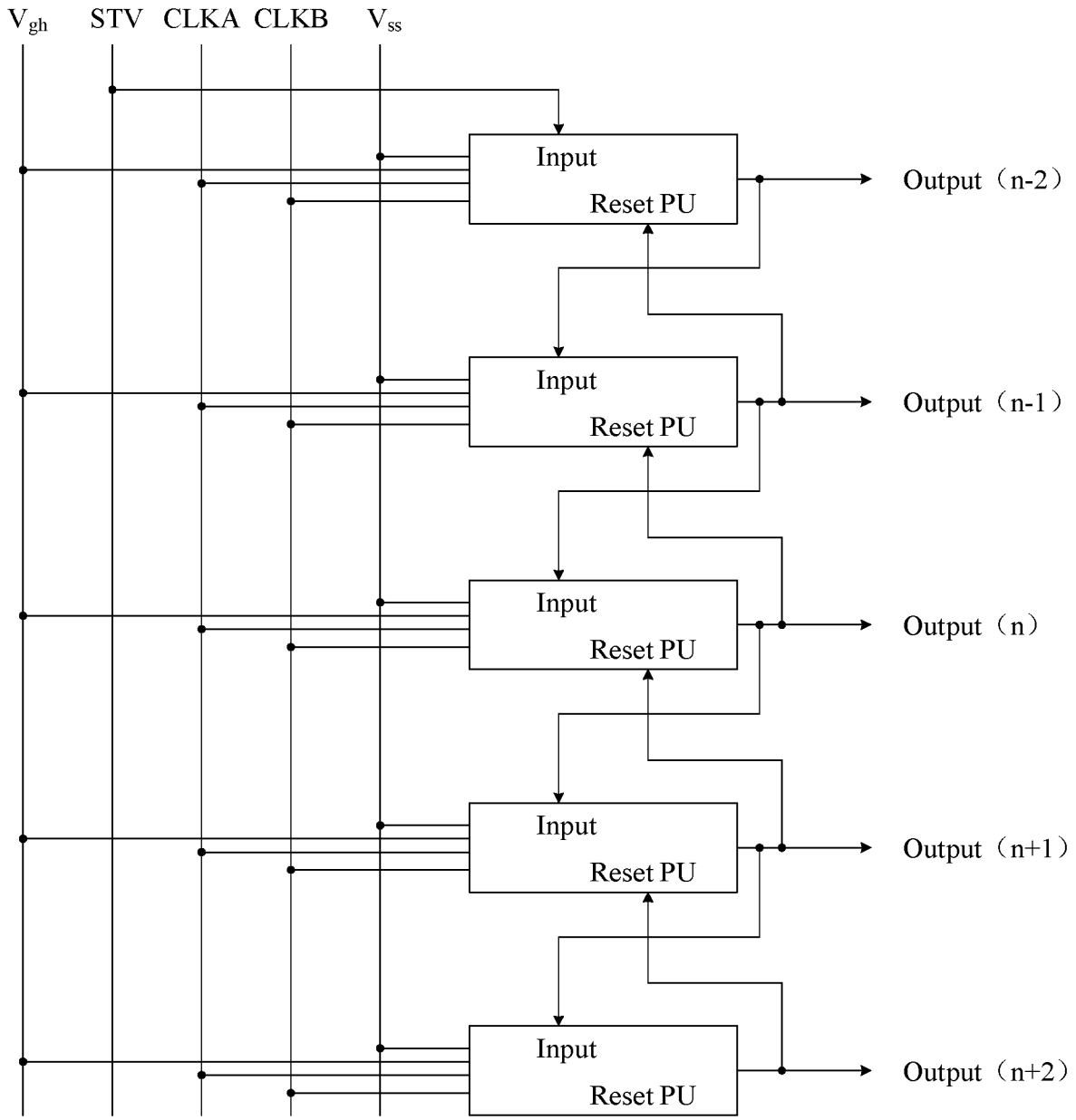
FIG. 6 is a schematic diagram of cascaded shift register circuits shown in FIG. 4.

The cascaded shift register circuits according to the present embodiment are as shown in FIG. 6. The shift register driver circuit includes a plurality of cascaded shift register circuits. Except the first and last shift register circuits, the input signal terminal Input of the shift register circuit at a middle stage is connected with the output signal terminal Output of the shift register circuit at a previous stage, the reset signal terminal Reset PU of the shift register circuit at the middle stage is connected with the output signal terminal Output of the shift register circuit at a next stage, the output terminal of the shift register circuit at the middle stage is connected with an end of a gate line; the input signal terminal Input of the first shift register circuit receives an initial signal STV (gate driver circuit shift register "displacement" pulse), and the reset signal terminal of the last shift register circuit receives a reset signal Reset. Therefore, if the shift register circuit according to the present embodiment is the nth shift register circuit, its input signal is an output signal Output (n−1) of the (n−1)th shift register circuit, its reset signal is an output signal Output (n+1) of the (n+1)th shift register circuit, and its output signal is Output (n).

It should be noted that in FIG. 6, the high-level signal terminal $V_1$ is connected with the power supply voltage signal terminal $V_{gh}$ which may provide the high-level signal, and each shift register is connected with the power supply voltage signal terminal $V_{gh}$, the first clock signal terminal CLKA, and the second clock signal terminal CLKB.

Figure 8:
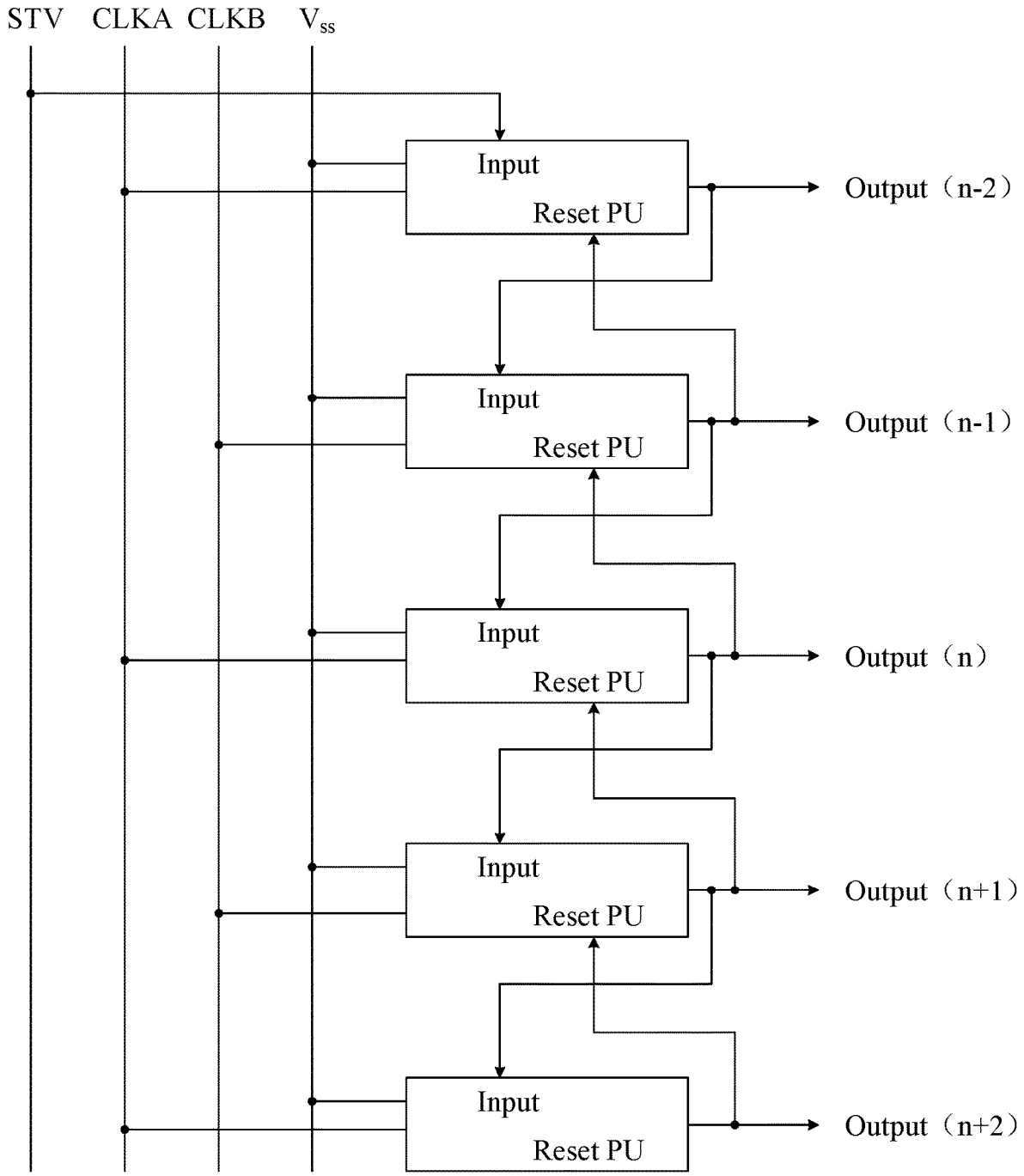
FIG. 8 is a schematic diagram of cascaded shift register circuits shown in FIG. 7.

The high-level signal terminal $V_1$ according to the embodiment of the present disclosure may also be connected with the clock signal terminal CI. For example, the high-level signal terminals $V_1$ of the shift register circuits in odd-numbered rows are connected with the first clock signal terminal CLKA, the high-level signal terminals of the shift register circuits in even-numbered rows are connected with the second clock signal terminal CLKB; or, the high-level signal terminals of the shift register circuits in even-numbered rows are connected with the first clock signal terminal CLKA, and the high-level signal terminals of the shift register circuits in odd-numbered rows are connected with the second clock signal terminal CLKB. As shown in FIG. 7, the driving principle of the shift register circuit in FIG. 7 in each period of time is the same as that in the above-mentioned embodiment except that the shift register circuit in FIG. 7 is not provided with the power supply voltage signal terminal $V_{gh}$, and the clock signal terminal CI is taken as the high-level signal terminal $V_1$ to provide a high level for the shift register circuit. In order for the input signal of the high-level signal terminal $V_1$ to have the high level when the eleventh thin film transistor M11 is turned on, the high-level signal terminal $V_1$ is required to be connected to the clock signal terminal CI which outputs the high level when the eleventh thin film transistor M11 is turned on, when the clock signal terminal CI is taken as the high-level signal terminal $V_1$. As shown in FIG. 8, since the signals provided by the first clock signal terminal CLKA has an inverted phase with respect to the second clock signal terminal CLKB, it can be seen from the drawings that two adjacent shift register circuits are connected with the first clock signal terminal CLKA or the second clock signal terminal CLKB respectively. If the shift register circuit according to the present embodiment is the nth shift register circuit, when the eleventh thin film transistor M11 of the nth shift register circuit is turned on, the first clock signal terminal CLKA has a high level, and the high-level signal terminal $V_1$ of the nth shift register circuit is connected with the first clock signal terminal CLKA; in the previous period of time before the eleventh thin film transistor M11 of the nth shift register circuit is turned on or in the next period of time after the eleventh thin film transistor M11 of the nth shift register circuit is turned on, the second clock signal terminal CLKB has a high level, so the high-level signal terminals of the (n−1)th shift register circuit and the (n+1)th shift register circuit are connected with the second clock signal terminal CLKB, thereby ensuring that a high level is input to the high-level signal terminal $V_1$ of each shift register circuit in the driving process of the circuit.

At least one embodiment of the present disclosure further provides a gate driver circuit, including a plurality of cascaded shift register circuits as mentioned above. The gate driver circuit may be directly integrated on the array substrate of the display device by adopting the same manufacturing process as the thin film transistor to realize the progressive scanning driving function.

Figure 9:
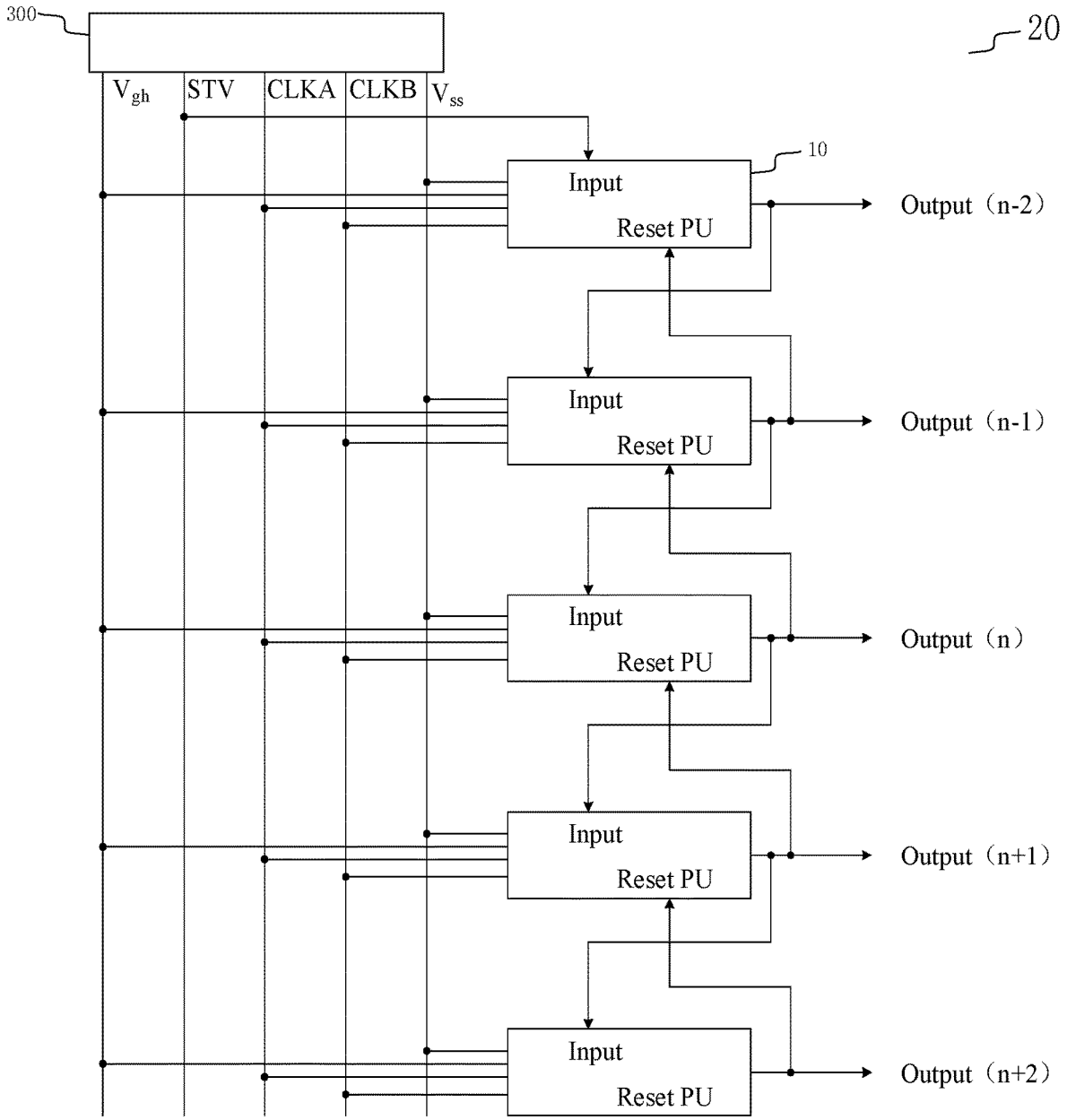
FIG. 9 is a schematic structural diagram of a gate driver circuit according to at least one embodiment of the present disclosure.

For example, FIG. 9 is a schematic structural diagram of a gate driver circuit 20 according to at least one embodiment of the present disclosure. As shown in FIG. 9, the gate driver circuit 20 includes a plurality of cascaded shift register circuits 10, each of which may be any one of the shift register circuits according to the above-mentioned embodiments.

For example, as shown in FIG. 9, except the first and last shift register circuits, the input signal terminal Input of the shift register circuit at a middle stage is connected with the output signal terminal Output of the shift register circuit at the previous stage, the reset signal terminal Reset PU is connected with the output signal terminal Output of the shift register circuit at the next stage, the output terminal Output is connected with an end of a gate line; the input signal terminal Input of the shift register circuit at the first stage receives an initial signal STV (gate driver circuit shift register "displacement" pulse), and the reset signal terminal of the shift register circuit at the last stage receives a reset signal Reset.

For example, as shown in FIG. 9, this gate driver circuit 20 may further include a timing controller 300. The timing controller 300 is configured to provide the power supply voltage signal terminal $V_{gh}$, the first clock signal terminal CLKA, the second clock signal terminal CLKB and the low-level signal terminal $V_{ss}$, and the timing controller 300 may further be configured to provide the initial signal STV and the reset signal Reset.

Figure 10:
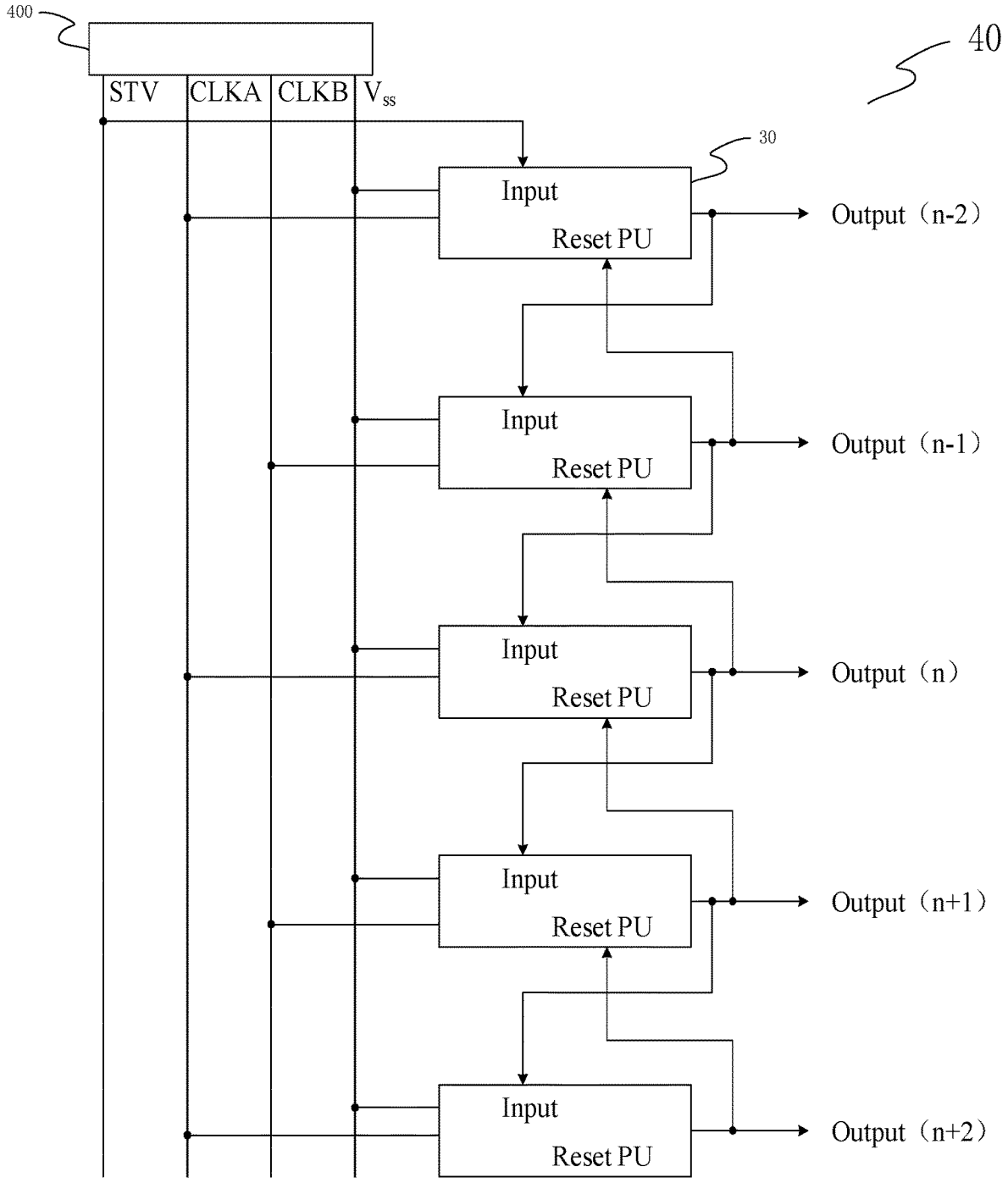
FIG. 10 is a schematic structural diagram of a gate driver circuit according to at least one embodiment of the present disclosure.

For example, FIG. 10 is a schematic structural diagram of a gate driver circuit 40 according to at least one embodiment of the present disclosure. As shown in FIG. 10, the gate driver circuit 40 includes a plurality of cascaded shift register circuits 30, each of which may be any one of the shift register circuits according to the above-mentioned embodiments.

For example, as shown in FIG. 10, except the first and last shift register circuits, the input signal terminal Input of the shift register circuit at a middle stage is connected with the output signal terminal Output of the shift register circuit at the previous stage, the reset signal terminal Reset PU is connected with the output signal terminal Output of the shift register circuit at the next stage, the output terminal Output is connected with an end of a gate line; the input signal terminal Input of the shift register circuit at the first stage receives an initial signal STV (gate driver circuit shift register "displacement" pulse), and the reset signal terminal of the shift register circuit at the last stage receives a reset signal Reset.

For example, as shown in FIG. 10, this gate driver circuit 20 may further include a timing controller 400. The timing controller 400 is configured to provide the first clock signal terminal CLKA, the second clock signal terminal CLKB and the low-level signal terminal $V_{ss}$, and the timing controller 400 may further be configured to provide the initial signal STV and the reset signal Reset. The first voltage terminals of two adjacent shift register circuits are connected with the first clock signal terminal CLKA or the second clock signal terminal CLKB, respectively.

It should be noted that in the embodiments of the present disclosure, a shift register unit B represents the shift register unit at the next stage of another shift register unit A: the gate scan signal output by the shift register unit B is later than the gate scan signal output from the shift register unit A in time. Correspondingly, a shift register unit B represents the shift register unit at the previous stage of another shift register unit A: the gate scan signal output by the shift register unit B is earlier than the gate scan signal output from the shift register unit A in time.

At least one embodiment of the present disclosure further provides an array substrate, including the above-mentioned gate driver circuit. The shift register circuit in the array substrate has the same advantages as the shift register circuit in the above-mentioned embodiment, which will not repeated herein.

Figure 11:
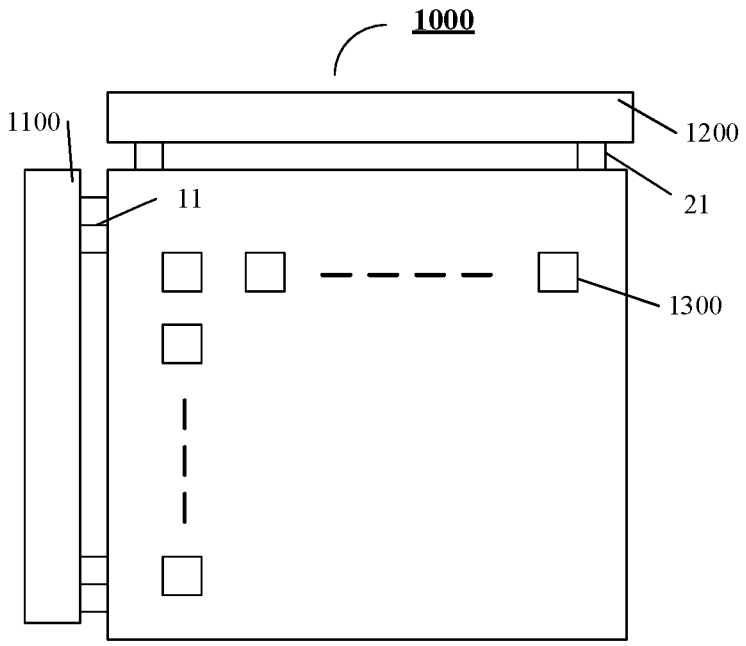
FIG. 11 is a schematic structural diagram of an array substrate according to at least one embodiment of the present disclosure.

As shown in FIG. 11, the array substrate 1000 according to at least one embodiment of the present disclosure includes any gate driver circuit 1100 according to the embodiments of the present disclosure. The array substrate 1000 includes an array consisting of a plurality of pixel units 1300. For example, the array substrate 1000 may further include a data driver circuit 1200. The data driver circuit 1200 is configured for providing a data signal for the pixel array; the gate driver circuit 1100 is configured for providing a gate scan signal for the pixel array. The data driver circuit 1200 is electrically connected with the pixel unit 1300 via the data lines 21, and the gate driver circuit 1100 is electrically connected with the pixel unit 1300 via the gate lines 11.

For example, in some embodiments, the high-level signal terminal $V_1$ of the shift register circuit in the array substrate may be connected with the power supply voltage signal terminal $V_{gh}$ which may provide the high-level signal, and may also be connected with the clock signal terminal CI. For example, in some embodiments, the high-level signal terminals $V_1$ of the shift register circuits in odd-numbered rows are connected with the first clock signal terminal CLKA, and the high-level signal terminals of the shift register circuits in even-numbered rows are connected with the second clock signal terminal CLKB. For example, in some other embodiments, the high-level signal terminals of the shift register circuits in even-numbered rows are connected with the first clock signal terminal CLKA, and the high-level signal terminals of the shift register circuits in odd-numbered rows are connected with the second clock signal terminal CLKB.

Figure 12:
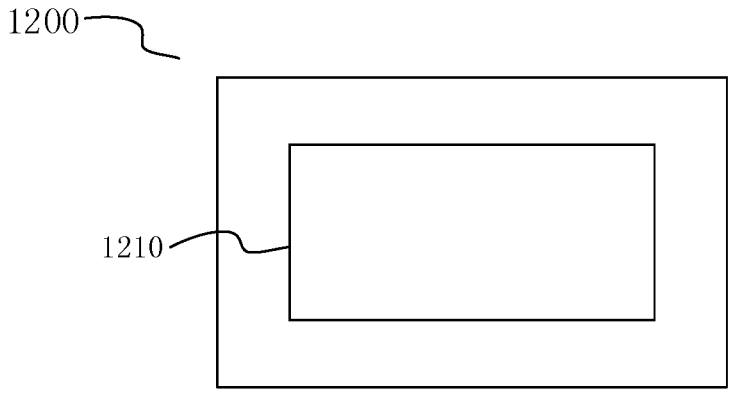
FIG. 12 is a schematic structural diagram of a display device according to at least one embodiment of the present disclosure.

At least one embodiment of the present disclosure further provides a display device, including any one of the above-mentioned display substrates. As shown in FIG. 12, the display device 1200 according to at least one embodiment of the present disclosure includes any of the mentioned-above array substrates 1210.

The display device according to some embodiments of the present disclosure may be a liquid crystal panel, an electronic paper or an OLED (Organic Light-Emitting Diode) panel, and is applied to any product or component with a display function, such as a mobile phone, a tablet PC, a TV, a display, a notebook computer, a digital photo frame, a navigator, or the like.

What are described above is related to the illustrative embodiments of the disclosure only and not limitative to the scope of the disclosure; the scopes of the disclosure are defined by the accompanying claims.

What is claimed is:

1. A shift register circuit, comprising an input sub-circuit and a signal output sub-circuit, wherein the input sub-circuit comprises:

a control module, the control module being connected with an input signal terminal and a first voltage terminal, and the control module being configured to output a signal of the first voltage terminal to a voltage dividing node under a control of an input signal provided by the input signal terminal;

an input module, an input terminal of the input module being connected with the voltage dividing node, an output terminal of the input module being connected with the signal output sub-circuit, the input module being configured to output a signal of the voltage dividing node to the signal output sub-circuit under a control of the control module; and a voltage dividing module, a first terminal of the voltage dividing module being connected with the control module, a second terminal of the voltage dividing module being connected with a second voltage terminal, a resistance value of the voltage dividing module having a negative relationship with a temperature, and the signal output sub-circuit is connected with an output terminal of the input module, and the signal output sub-circuit is configured to output a gate scan signal from an output signal terminal under a control of the input module, wherein the input module comprises a first thin film transistor, a control terminal and a first terminal of, the first thin film transistor are connected with the voltage dividing node, and a second terminal of the first thin film transistor is connected with the signal output sub-circuit;

wherein the signal output sub-circuit comprises a charging-discharging module, a second node holding module, a second node level changing module, a first node nose reduction module and a reset module, wherein a first input terminal of the charging-discharging module is connected with an output terminal of the input module and an output terminal of the first node noise reduction module at a first node, a second, input terminal of the charging-discharging module is connected with a first clock signal terminal, an output terminal of the charging-discharging module is connected with the output signal terminal, and the charging-discharging module is configured for performing a first charging operation under a combined action of an output signal of the first thin film transistor and a first clock signal provided by the first clock signal terminal, and performing a second charging operation and outputting a gate scan signal under an action of a potential of the first node and the first clock signal;

a first input terminal of the second node holding module is connected with the second voltage terminal, a second input terminal of the second node holding module is connected with the first node, a first output terminal of the second node holding module is connected with a second input terminal of the second node level changing module, a second output terminal of the second node holding module is connected with an output terminal of the second node level changing, module, a third input terminal of the first node noise reduction module and a second input terminal of the reset module at a second node, and the second node holding module is configured for keeping a potential of the second node invalid under a combined action of the potential of the first node and an invalid potential signal provided by the second voltage terminal;

a first, input terminal of the second node level changing module is connected with a second clock signal terminal, a second input terminal of the second node level changing module is connected with a first output terminal of the second node holding module, an output terminal of the second node level changing module is connected with the second node, and the second node level changing module is configured for changing the potential of the second node under a combined action of a second clock signal provided by the second clock signal terminal and an output signal of the second node holding module;

a first input terminal of the first node noise reduction module is connected with the reset signal terminal, a second input terminal of the first node noise reduction module is connected with the second voltage terminal, a third input terminal of the first node noise reduction module is connected with the second node, an output terminal of the first node noise reduction module is connected with the first node, and the first node noise reduction module is configured for changing the potential of the first node under a combined action of a reset signal provided by the reset signal terminal, the invalid potential signal provided by the second voltage terminal and the potential of the second node;

a first input terminal of the reset module is connected with the reset signal terminal, a second input terminal of the reset module is connected with the second node, a third input terminal of the reset module, is connected with the second voltage terminal, an output terminal of the reset module is connected with the output signal terminal, and the reset module is configured for resetting a potential of the output signal terminal under a combined action of the reset signal provided by the reset signal terminal, the potential of the second node and the invalid potential signal provided by the second voltage terminal; and the first clock signal has an inverted phase with respect to the second clock signal.

2. The shift register circuit according to claim 1, wherein the control module comprises an input thin film transistor, a control terminal of the input thin film transistor is connected with the input signal terminal, a first terminal of the input thin film transistor is connected with the first voltage terminal, and a second terminal of the input thin film transistor is connected with the voltage dividing node.

3. The shift register circuit according to claim 1, wherein the first voltage terminal is a power supply voltage signal terminal which is capable of providing an effective potential signal.

4. The shift register circuit according to claim 1, wherein the voltage dividing module comprises a thermistor, a terminal of the thermistor is connected with the voltage dividing node, and a remaining terminal of the thermistor is connected with the second voltage terminal, and the thermistor comprises a negative temperature coefficient thermistor.

5. The shift register circuit according to claim 4, wherein a zero power resistance of the negative temperature coefficient thermistor is in a range of 210Ω~230Ω at an operating temperature in a range of −25° C.~105° C.

6. The shift register circuit according to claim 1, wherein the first voltage terminal is connected with a power supply voltage signal terminal which is capable of providing an effective potential signal.

7. The shift register circuit according to claim 1, wherein the charging-discharging module comprises:

a third thin film transistor, a control terminal of the third thin film transistor being connected with the first node, a first terminal of the third thin film transistor being connected with the first clock signal terminal, a second terminal of the third thin film transistor being connected with the output signal terminal; and a storage capacitor, a first terminal of the storage capacitor being connected with the first node, and a second terminal of the storage capacitor being connected with the output signal terminal.

8. The shift register circuit according to claim 1, wherein the second node holding module comprises:

a sixth thin film transistor, a control terminal of the sixth thin film transistor being connected with the first node, a first terminal of the sixth thin film transistor being connected with the second voltage terminal, and a second terminal of the sixth thin film transistor being connected with the second node; and an eighth thin film transistor, a control terminal of the eighth thin film transistor being connected with the first node, a first terminal of the eighth thin film transistor being connected with the second voltage terminal, and a second terminal of the eighth thin film transistor being connected with the second node level changing module.

9. The shift register circuit according to claim 1, wherein the second node level changing module comprises:

a ninth thin film transistor, a control terminal and a first terminal of the ninth thin film transistor being connected with the second clock signal terminal, a second terminal of the ninth thin film transistor being connected with a control terminal of a fifth thin film transistor; and a fifth thin film transistor, the control terminal of the fifth thin film transistor being connected with the second terminal of the ninth thin film transistor, a first terminal of the fifth thin film transistor being connected with the second voltage terminal, and a second terminal of the fifth thin film transistor being connected with the first node.

10. The shift register circuit according to claim 1, wherein the first node noise reduction module comprises:

a second thin film transistor, a control terminal of the second thin film transistor being connected with the reset signal terminal, a first terminal of the second thin film transistor being connected with the second voltage terminal, a second terminal of the second thin film transistor being connected with the first node; and a tenth thin film transistor, a control terminal of the tenth thin film transistor being connected with the second node, a first terminal of the tenth thin film transistor being connected with the second voltage terminal, and a second terminal of the tenth thin film transistor being connected with the first node.

11. The shift register circuit according to claim 1, wherein the reset module comprises:

a fourth thin film transistor, a control terminal of the fourth thin film transistor being connected with the reset signal terminal, a first terminal of the fourth thin film transistor being connected with the second voltage terminal, a second terminal of the fourth thin film transistor being connected with the output signal terminal; and a seventh thin film transistor, a control terminal of the seventh thin film transistor being connected with the second node, a first terminal of the seventh thin film transistor being connected with the second voltage terminal, and a second terminal of the seventh thin film transistor being connected with the output signal terminal.

12. The shift register circuit according to claim 2, wherein the input thin film transistor is a P type thin film transistor or an N type thin film transistor.

13. The shift register circuit according to claim 1, wherein the input signal terminal and the first voltage terminal are a same terminal.

14. The shift register circuit according to claim 1, wherein the first voltage terminal is connected with the first clock signal terminal or the second clock signal terminal.

15. A gate driver circuit, comprising a plurality of cascaded shift register circuits, each of the plurality of cascaded shift register circuits being the shift register circuit according to claim 1.

16. An array substrate, comprising the gate driver circuit according to 15.

17. A display device, comprising the array substrate according to claim 16.

18. A method of driving the shift register circuit according to claim 1, comprising:

inputting a signal having an effective potential to the input signal terminal, inputting a signal having an invalid potential to the first clock signal terminal so that the control module outputs an effective potential signal from the first voltage terminal to the voltage dividing node, and the input module outputs the signal of the voltage dividing node to the first node under the control of the control module, so as to charge the charging-discharging module;

inputting a signal having the effective potential to the first clock signal terminal, inputting a signal having an invalid potential to the input signal terminal to charge the charging-discharging module so that the charging-discharging module outputs a signal which is from the first clock signal terminal and has the effective potential to the output signal terminal under a control of the first node; and inputting a signal having the effective potential to the reset signal terminal and the second clock signal terminal so that the second node level changing module changes the potential of the second node to the effective potential, and the reset module outputs the invalid potential signal from the second voltage terminal to the output signal terminal under a control of the second node at the effective potential and the reset signal terminal at the effective potential.

* * * * *